US009709343B2

(12) United States Patent
Brümmer et al.

(10) Patent No.: US 9,709,343 B2
(45) Date of Patent: Jul. 18, 2017

(54) HEAT EXCHANGER

(71) Applicant: Behr GmbH & Co. KG, Stuttgart (DE)

(72) Inventors: Richard Brümmer, Stuttgart (DE); Gunther Hentschel, Uhingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 322 days.

(21) Appl. No.: 14/043,962

(22) Filed: Oct. 2, 2013

(65) Prior Publication Data

US 2014/0096936 A1 Apr. 10, 2014

(30) Foreign Application Priority Data

Oct. 2, 2012 (DE) ..... 10 2012 218 069

(51) Int. Cl.
*G05D 15/00* (2006.01)
*G05D 16/00* (2006.01)
(Continued)

(52) U.S. Cl.
CPC ..... *F28F 9/0209* (2013.01); *F01P 7/165* (2013.01); *F28D 1/05375* (2013.01); *F28F 1/12* (2013.01); *F28F 27/02* (2013.01); *F28F 2250/06* (2013.01)

(58) Field of Classification Search
CPC ..... F28D 1/047; F28D 1/0443; F28D 15/06; F24F 1/025
(Continued)

(56) References Cited

U.S. PATENT DOCUMENTS 1,416,945 A * 5/1922 Chardard ..... F28D 1/047 165/151
2,071,026 A * 2/1937 Crosley, Jr. ..... F24F 1/025 165/115
(Continued)

FOREIGN PATENT DOCUMENTS

CN 101479554 A 7/2009
DE 42 32 366 A1 3/1994
(Continued)

OTHER PUBLICATIONS

German Search Report, Application No. DE 10 2012 218 069.9, Sep. 4, 2013, 5 pgs.
(Continued)

*Primary Examiner* — Ljiljana Ciric
(74) *Attorney, Agent, or Firm* — Paul D. Strain, Esq.; Strain & Strain PLLC

(57) ABSTRACT

A coolant cooler has a cooling block formed by tubes arranged parallel to one another. The tubes form multiple first flow ducts through which a first fluid can flow. In regions between the tubes multiple second flow ducts are formed through which a second fluid can flow. The coolant cooler includes a first collecting box on which a first fluid inlet is arranged and a second collecting box on which a first fluid outlet is arranged. The first flow ducts are in fluid communication with a first cooling circuit via the first fluid inlet, the first fluid outlet, and the collecting boxes. The first or second collecting box has a second fluid inlet and a second fluid outlet such that the second fluid inlet, the respective collecting box, and the second fluid outlet are in fluid communication with a second cooling circuit.

12 Claims, 3 Drawing Sheets

(51) Int. Cl.

| | |
|---|---|
| ***G05D 23/00*** | (2006.01) |
| ***F28F 9/02*** | (2006.01) |
| ***F28F 1/12*** | (2006.01) |
| ***F28F 27/02*** | (2006.01) |
| ***F28D 1/053*** | (2006.01) |
| ***F01P 7/16*** | (2006.01) |

(58) Field of Classification Search
USPC ..... 165/279, 296, 297, 151
See application file for complete search history.

(56) References Cited

U.S. PATENT DOCUMENTS

| | | | | |
|---|---|---|---|---|
| 2,179,702 | A * | 11/1939 | Saunders | F28D 1/0426 165/140 |
| 3,601,878 | A * | 8/1971 | Karmazin | B21D 53/08 165/149 |
| 3,606,282 | A * | 9/1971 | Saunders | F28F 27/00 165/279 |
| 3,776,305 | A * | 12/1973 | Simmons | F28D 15/06 165/104.14 |
| 3,863,708 | A * | 2/1975 | Grimes | B01D 51/10 165/134.1 |
| 4,156,408 | A * | 5/1979 | Protze | B60K 11/04 123/41.09 |
| 4,319,630 | A * | 3/1982 | Hronek | F28D 7/0008 165/140 |
| 4,483,392 | A * | 11/1984 | Korsmo | F28D 7/08 165/122 |
| 4,690,209 | A * | 9/1987 | Martin | F25B 39/02 165/135 |
| 5,526,873 | A | 6/1996 | Marsais et al. | |
| 7,506,683 | B2 * | 3/2009 | Hu | F28D 1/0443 165/140 |
| 2004/0050543 | A1 | 3/2004 | Kim et al. | |
| 2005/0257921 | A1 | 11/2005 | Hu | |
| 2005/0269062 | A1 | 12/2005 | Guerrero et al. | |
| 2006/0254538 | A1 | 11/2006 | Hassdenteufel et al. | |
| 2008/0047687 | A1 | 2/2008 | Leitch et al. | |
| 2011/0073291 | A1 | 3/2011 | Hu | |
| 2014/0096937 | A1 | 4/2014 | Brümmer et al. | |
| 2016/0178291 | A1 | 6/2016 | Brümmer et al. | |

FOREIGN PATENT DOCUMENTS

| | | | |
|---|---|---|---|
| DE | 195 18 323 | A1 | 11/1996 |
| DE | 100 45 905 | A1 | 3/2002 |
| DE | 101 02 640 | A1 | 7/2002 |
| DE | 10 2005 047 840 | A1 | 6/2006 |
| DE | 602 16 049 | T2 | 7/2007 |
| DE | 10 2006 036 742 | A1 | 2/2008 |
| DE | 10 2006 061 440 | A1 | 6/2008 |
| DE | 10 2010 049 094 | A1 | 6/2011 |
| DE | 10 2011 083 345 | A1 | 4/2012 |
| FR | 2 682 160 | A | 4/1993 |
| JP | 6-81648 | A | 3/1994 |
| WO | WO 2004/063543 | A2 | 7/2004 |
| WO | WO 2008/074953 | A1 | 6/2008 |
| WO | WO 2010/008960 | A2 | 1/2010 |
| WO | WO 2011/134786 | A1 | 11/2011 |

OTHER PUBLICATIONS

German Search Report, Appl. No. 10 2013 220 031.5, Feb. 7, 2014, 5 pgs.
German Search Report, Appl. No. 10 2013 220 039.0, Mar. 5, 2014, 5 pgs.
Brümmer, U.S. PTO Notice of Allowance, U.S. Appl. No. 14/043,990, Jul. 21, 2016, 13 pgs.
Brümmer, U.S. PTO Office Action, U.S. Appl. No. 14/043,990, Apr. 5, 2016, 13 pgs.
Brümmer, U.S. PTO Office Action, U.S. Appl. No. 14/043,990, Sep. 16, 2015, 5 pgs.
Brümmer, U.S. PTO Office Action, U.S. Appl. No. 14/043,990, Dec. 29, 2016, 13 pgs.
Brümmer, U.S. PTO Notice of Allowance, U.S. Appl. No. 14/043,990, Apr. 6, 2017.

* cited by examiner

HEAT EXCHANGER

CROSS-REFERENCE TO RELATED PATENT APPLICATIONS

This application is based upon and claims the benefit of priority from prior German Patent Application No. 10 2012 218 069.9, filed Oct. 2, 2012, the entire contents of which are incorporated herein by reference in their entirety.

TECHNICAL FIELD

The invention relates to a heat exchanger, in particular a coolant cooler, for a motor vehicle, having a block which is formed by tubes arranged parallel to one another and by fins arranged between the tubes, wherein the tubes form multiple first flow ducts through which a first fluid can flow, wherein the regions between the tubes form multiple second flow ducts through which a second fluid can flow around the tubes, having a first collecting box on which a first fluid inlet is arranged, having a second collecting box on which a first fluid outlet is arranged, wherein the first flow ducts are in fluid communication with a first cooling circuit via the first fluid inlet, the first fluid outlet and the collecting boxes.

PRIOR ART

In engine coolant circuits of motor vehicles there circulates a coolant which cools the components integrated into the circuit and thus keeps these in the most optimum possible temperature window for their operation.

In order, in the case of low engine temperatures, to ensure a fast warm-up of the engine to an optimum operating temperature, the coolant circuits often have a thermostat which is switched as a function of the temperature of the coolant. By means of said thermostat, parts of the coolant circuit can be opened up or closed.

Some components, such as for example waste heat recovery condensers (condensers for the utilization of waste heat), require as low a temperature as possible for optimum operation. The component is therefore advantageously permanently cooled by a coolant.

Operating states however exist in which the coolant circuit is influenced by the thermostat such that the coolant flow through the main coolant cooler is greatly reduced or even stopped. There is then no longer a flow, or at least no longer an adequate flow, through the components that require cooling, said components often being integrated into the coolant circuit directly downstream of the main coolant cooler.

In the prior art, solutions are known in which, for example, there is integrated an additional coolant cooler which is traversed by flow independently of the main coolant cooler. For this purpose, the existing coolant circuit is expanded to include extra lines and an additional coolant cooler. The additional elements result in costs being incurred, and additional installation space is required.

Solutions are also known in which, via a bypass, coolant is branched off from the feed line of the main coolant cooler and, after flowing through the component to be cooled, is supplied back to the coolant circuit. Here, the cooling action of the main coolant cooler is not utilized because the coolant is conducted past the main coolant cooler. To be able to activate the bypass according to the situation, additional valves and/or thermostats are required. As a result of these additional elements, it is likewise the case that additional costs are incurred and additional installation space is required.

A disadvantage of the solutions according to the prior art is that individual components that require constant cooling by means of a coolant are either not sufficiently cooled by coolant, or the cooling of the components is realized only by means of additional coolant coolers and/or bypass branches.

PRESENTATION OF THE INVENTION, PROBLEM, SOLUTION, ADVANTAGES

The problem addressed by the present invention is therefore that of providing a heat exchanger which creates a simple and inexpensive facility for cooling components in the coolant circuit by means of a coolant, in particular when the coolant flow through the main coolant cooler is greatly reduced or stopped. Said problem also consists in providing an arrangement of a heat exchanger of said type in a motor vehicle.

The problem addressed by the present invention is solved by means of a heat exchanger having the features of Claim 1.

An exemplary embodiment of the invention relates to a heat exchanger, in particular a coolant cooler, for a motor vehicle, having a block which is formed by tubes arranged parallel to one another and by fins arranged between the tubes, wherein the tubes form multiple first flow ducts through which a first fluid can flow, wherein the regions between the tubes form multiple second flow ducts through which a second fluid can flow around the tubes, having a first collecting box on which a first fluid inlet is arranged, having a second collecting box on which a first fluid outlet is arranged, wherein the first flow ducts are in fluid communication with a first cooling circuit via the first fluid inlet, the first fluid outlet and the collecting boxes, wherein the first collecting box or the second collecting box has a second fluid inlet and a second fluid outlet, wherein the second fluid inlet, the respective collecting box and the second fluid outlet are in fluid communication with a second cooling circuit.

Here, the heat exchanger may for example be a heat exchanger through which flow passes vertically or a heat exchanger through which flow passes horizontally. The heat exchanger is in fluid communication, via the first fluid inlet and the first fluid outlet, with a first cooling circuit. Here, said first cooling circuit may for example refer to the main cooling circuit of a vehicle, which generally runs through the internal combustion engine. The first fluid flows through said first cooling circuit.

The heat exchanger is in fluid communication, via the second fluid inlet and the second fluid outlet, with a second cooling circuit. Said second cooling circuit serves for cooling a component, for example a waste heat recovery condenser. Here, the second cooling circuit is branched off from the heat exchanger and is supplied to the heat exchanger again after flow has passed through the second cooling circuit.

The first flow ducts are advantageously formed from flat tubes. A flat tube is composed substantially of two opposite large flat side surfaces which are connected to one another via two narrow sides. The plane of the flow ducts thus refers to a plane running parallel to the large flat side surfaces of the flat tubes.

Here, in one preferred exemplary embodiment, the block of the heat exchanger is composed of a multiplicity of flat tubes which are arranged parallel to one another and which form the first flow ducts. The second flow duct is formed between said flat tubes. In these there may advantageously be arranged fins which can promote the exchange of heat.

The construction of the heat exchanger with a block of flat tubes and fins arranged in between constitutes a construction as a tube-fin heat exchanger. This is particularly advantageous because a large number of commonly used heat exchangers are of this type of construction. Such heat exchangers are correspondingly inexpensive and are available in a wide variety of dimensions.

Furthermore, it is advantageous for the second collecting box to have the second fluid inlet and the second fluid outlet.

By means of the arrangement of the second fluid inlet and second fluid outlet on the second collecting box, it is achieved that the fluid that is branched off in the second cooling circuit is branched off from a region of the heat exchanger in which the temperature of the fluid is at its lowest. The maximum possible cooling action for the components in the second cooling circuit is achieved in this way.

In a further advantageous embodiment, it may be provided that the first fluid inlet is arranged on one of the two end regions of the first collecting box and that the first fluid outlet is arranged in the central region of the second collecting box.

By means of an arrangement of the first fluid inlet on one edge region of a collecting box and the arrangement of the first fluid outlet in the central region of the other collecting box, a homogenization of the fluid distribution within the heat exchanger is realized. This leads to improved efficiency of the heat exchanger.

It is also expedient for the second fluid outlet and the second fluid inlet to be arranged on the same side of the second collecting box as the first fluid outlet and/or on the opposite side.

By means of an arrangement of the second fluid inlet and of the second fluid outlet on the same side as the first fluid outlet, the flow through the second cooling circuit is improved because the required circulation of the fluid within the heat exchanger through the second cooling circuit is less intense than it would be in the case of a larger spacing between the second fluid inlet and the second fluid outlet.

An arrangement of the second fluid inlet and of the second fluid outlet on different sides may be advantageous if a greater cooling action is required. As a result of the relatively large spacing between the second fluid inlet and the second fluid outlet, a larger amount of fluid can be circulated within the heat exchanger. In this way, a greater cooling action can be attained.

It is also advantageous for the first fluid inlet, the first fluid outlet, the second fluid outlet and the second fluid inlet to be arranged in a direction perpendicular to the plane of the flow ducts.

The arrangement of the fluid inlets and fluid outlets in a direction perpendicular to the plane of the flow ducts is particularly advantageous because all of the fluid ports are arranged on a common outer side of the heat exchanger. This promotes simple manufacturing of the heat exchanger.

The plane of the flow ducts thus refers to the plane formed by the flow ducts. This is for example the common plane of the central axes of the flow ducts.

A particularly preferred embodiment of the invention may be characterized in that the heat exchanger has a means for reducing and/or preventing a fluid flow from the second fluid inlet to the second fluid outlet, which means is arranged in the first or in the second collecting box.

As a result of the reduction of the fluid flow between the second fluid outlet and the second fluid inlet, a short circuit can be prevented. Such a short circuit would arise if the fluid within the collecting box were to flow directly from the second fluid inlet to the second fluid outlet without flowing through the heat exchanger itself. By greatly reducing or completely preventing said fluid flow, it is possible to realize increased cooling of the fluid in the heat exchanger, which leads to more intense cooling of the component to be cooled.

It may also be advantageous for the collecting box that has the first fluid outlet to have a means for increasing the pressure loss, which means divides the collecting box, in a direction perpendicular to the plane of the flow ducts, into a left-hand region and a right-hand region.

A means for increasing the pressure loss in the collecting box that has the first fluid outlet may likewise be conducive to the fluid flow through the second cooling circuit.

A partition, for example, may be used as a means for increasing the pressure loss. Said partition may extend, parallel to the plane of the flow ducts, through the entire collecting box, or only through part of the collecting box. In the extreme case, the partition, if arranged in a projection of the area of the opening of the first fluid outlet, could also project out through the first fluid outlet and even extend as far as into the coolant line.

The partition, or the means for increasing the pressure loss, is in this case advantageously but not imperatively also arranged between the second fluid inlet and the second fluid outlet. This further reduces the possibility of a short circuit being generated between these.

It may furthermore be advantageous for the means for reducing and/or preventing a fluid flow from the second fluid inlet to the second fluid outlet to be arranged in the first collecting box or in the second collecting box.

According to a preferred exemplary embodiment, it may be provided that, by way of the means for reducing and/or preventing a fluid flow from the second fluid inlet to the second fluid outlet, which means is arranged in the first or second collecting box, the pressure loss in the respective collecting box between the first fluid outlet and the second fluid outlet can be varied as a function of a pressure difference between the second fluid inlet and the second fluid outlet or as a function of the fluid temperature in the second cooling circuit.

It is also advantageous for the means for reducing and/or preventing a fluid flow from the second fluid inlet to the second fluid outlet to be arranged within the second collecting box.

Here, it may advantageously be provided that the means for reducing and/or preventing a fluid flow from the second fluid inlet to the second fluid outlet is a flap or a valve or a partition.

It is also preferable for at least one of the fluid inlets to be configured as a fluid inlet connector and/or for at least one of the fluid outlets to be configured as a fluid outlet connector.

The configuration of the fluid inlet as a fluid inlet connector and/or the configuration of the fluid outlet as a fluid outlet connector are particularly advantageous because fluid lines can be connected directly to said connectors, which facilitates the connection of the heat exchanger into a cooling circuit.

The object regarding the arrangement of the heat exchanger in a motor vehicle is achieved by means of an arrangement having the features of Claim 9, according to which it is advantageous if the heat exchanger is arranged in a motor vehicle and a component to be cooled is integrated into the second cooling circuit, or a component to be cooled and a fluid pump are integrated into the second cooling circuit.

It is possible for the second cooling circuit to be operated with a dedicated fluid pump or without a dedicated fluid pump. A dedicated fluid pump offers the advantage that the fluid in the heat exchanger can be actively circulated. This is advantageous in particular if the convection flow that arises in the heat exchanger owing to the different temperatures of the fluid is not sufficient.

By means of a fluid pump, the circulation in the heat exchanger can be increased, whereby the cooling action is also increased.

By contrast, a second cooling circuit without an additional fluid pump may be advantageous because, owing to the omission of the fluid pump, the costs are lower and less installation space is required.

It is also advantageous if, in the second cooling circuit, there is arranged a thermostat valve for regulating and/or controlling the fluid flow through the component to be cooled.

Advantageous refinements of the present invention are described in the subclaims and in the following description of the figures.

BRIEF DESCRIPTION OF THE DRAWINGS

Below, the invention will be explained in detail on the basis of an exemplary embodiment and with reference to the drawings, in which.

PREFERRED EMBODIMENT OF THE INVENTION

Figure 1:
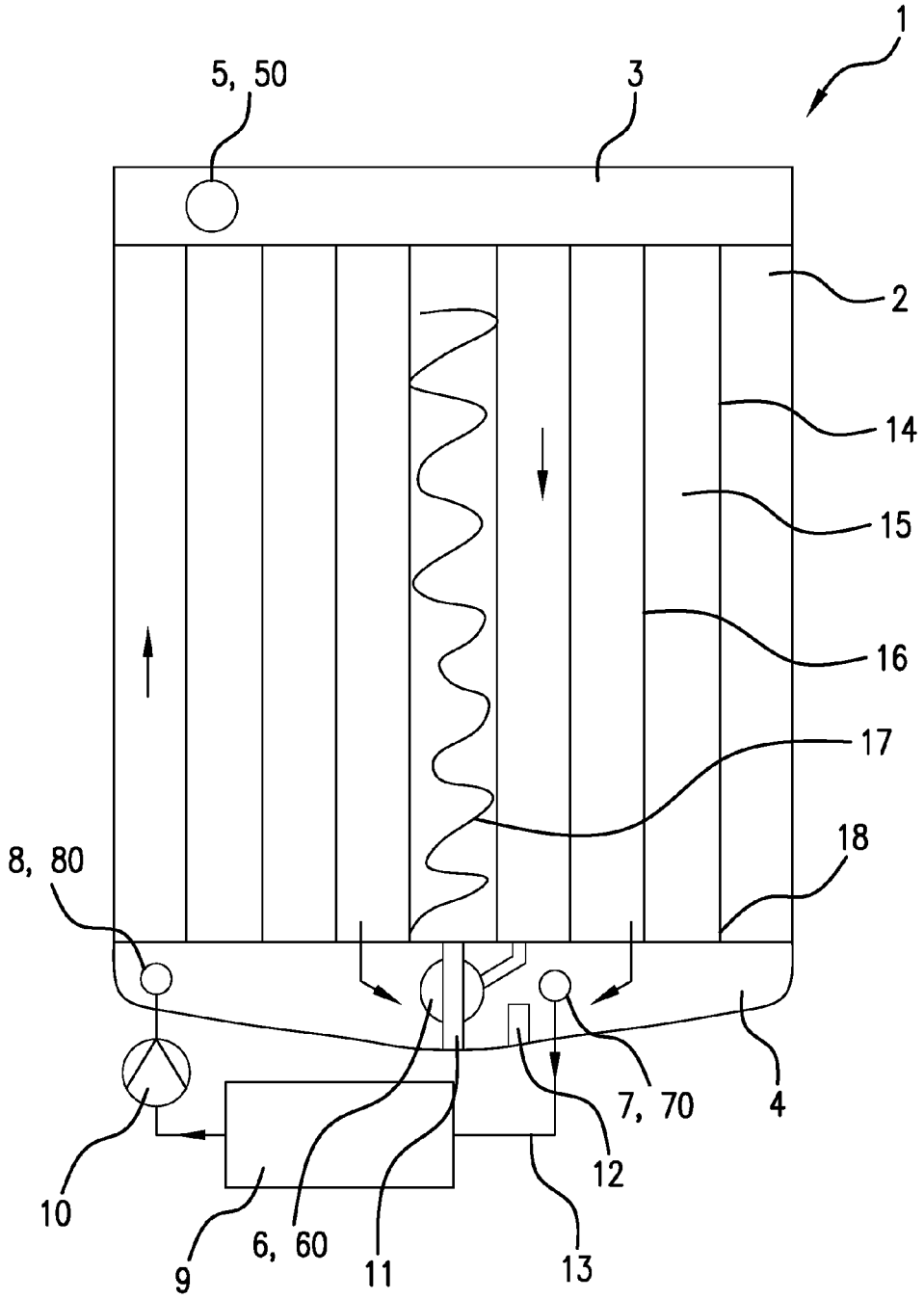
FIG. 1 shows a schematic view of a heat exchanger with a flap indicated and with a partition in one of the collecting boxes, and with a first and a second fluid inlet and a first and a second fluid outlet.

FIG. 1 shows a schematic view of a heat exchanger 1. The heat exchanger 1 is of a conventional type of construction.

The heat exchanger 1 is composed substantially of a block 2 which is composed of a multiplicity of flat tubes 16 arranged parallel to one another. Arranged between said flat tubes 16 are fins 17 which improve the exchange of heat. The flat tubes 16 are received, by way of their end regions 18, in collecting boxes 3, 4 and are in fluid communication with the latter.

Here, the flat tubes 16 form first flow ducts 14 through which a first fluid can flow. Here, a second fluid flows around the first flow ducts 14, which second fluid can flow through the second flow ducts 15.

The heat exchanger 1 is integrated into a cooling circuit which is not shown in FIG. 1. A first fluid is supplied to the heat exchanger 1 via the first fluid inlet 5, which first fluid flows through the heat exchanger 1. In the process, the fluid is cooled. The first fluid inlet 5 is arranged in the upper collecting box 3. The first fluid inlet can optionally be configured as a fluid inlet connector 50. After the fluid flows in through the first fluid inlet 5, the fluid distributes in the collecting box 3 over the entire width of the heat exchanger 1. The fluid subsequently flows downward to the second collecting box 4 along the flat tubes 16, indicated in FIG. 1, of the block 2.

The collecting box 4 has a first fluid outlet 6. Said first fluid outlet 6 is positioned centrally in the collecting box 4. The first fluid outlet can optionally be configured as a fluid inlet connector 60. The fluid that flows along the block 2 from the collecting box 3 into the collecting box 4 is guided into the central region of the collecting box 4 and flows out of the heat exchanger 1 through the first fluid outlet 6.

The first cooling circuit, which constitutes the main flow through the heat exchanger 1, may in certain operating situations be controlled such that the heat exchanger 1 is no longer actively traversed by flow. The fluid within the heat exchanger 1 is then substantially static in the interior of the heat exchanger 1 or flows through the heat exchanger 1 at a flow speed which is low in relation to normal operation.

The second collecting box 4 of the heat exchanger 1 has a second fluid outlet 7 and a second fluid inlet 8. Via said second fluid inlet and fluid outlet 7, 8, the heat exchanger 1 is in fluid communication with a second cooling circuit 13. The second fluid inlet and fluid outlet can optionally be configured as a fluid inlet/outlet connectors 70, 80.

The second cooling circuit 13 serves for the cooling of a component 9. In addition to the second cooling circuit 13 illustrated in FIG. 1, which has only one component 9 to be cooled, it is also possible for a cooling circuit to be provided which has a multiplicity of components 9 to be cooled.

The second fluid outlet 7 is arranged in the right-hand half of the collecting box 4. The second fluid inlet 8 is arranged at the left-hand end region of the collecting box 4. The first fluid outlet 6 is arranged between the second fluid outlet 7 and the second fluid inlet 8.

When the heat exchanger 1 is traversed by flow through the first cooling circuit in the usual way, the fluid situated in the heat exchanger 1 is likewise caused to flow through the second fluid outlet 7 into the second cooling circuit 13 and from there through the second fluid inlet 8 back into the collecting box 4 of the heat exchanger 1. In this case, the fluid pump 10, which in FIG. 1 is positioned downstream of the component 9 to be cooled, may be operated or may be traversed by flow whilst in a functionless state. If the fluid pump 10 is operated, it assists the flow through the second cooling circuit 13 and also the flow through the heat exchanger 1.

It is likewise possible, in an alternative embodiment, for the fluid pump to also be arranged upstream of the component to be cooled, or for the integration of a fluid pump to be dispensed with entirely.

When the flow through the heat exchanger 1 is greatly reduced or completely shut off by the first cooling circuit, for example as a result of the actuation of a thermostat, at least a major part of the fluid is static within the heat exchanger 1. A circulation of the fluid within the heat exchanger 1 and thus a supply of cooled fluid in the second cooling circuit 13 can then take place either on the basis of the principle of convection or with the aid of the fluid pump 10. The fluid pump 10 then independently delivers fluid through the second cooling circuit 13 and through at least a part of the heat exchanger 1.

Owing to the relatively warm fluid which flows into the heat exchanger 1 through the second fluid inlet 8 after the cooling of the component 9 and owing to the temperature difference that prevails between the fluid from the second cooling circuit 13 and the rest of the fluid in the heat exchanger 1, a flow movement is generated. Said convection flow has the effect that the warmed fluid from the second cooling circuit 13 rises in the heat exchanger 1 and, in the process, mixes with the relatively cold fluid in the heat exchanger 1, resulting in cooling of the fluid.

In the case of a heat exchanger 1 as shown in FIG. 1, the fluid flowing into the lower collecting box 4 of the heat exchanger 1 through a second fluid inlet 8 rises into the upper collecting box 3 through one proportion of the flat tubes 16. There, the fluid distributes over the length of the collecting box 3 and flows into the lower collecting box 4 through another proportion of the flat tubes 16. From there, the fluid, which has now been cooled again, flows through the second fluid outlet 7 into the second cooling circuit 13 again.

In this way, a flow is generated through the heat exchanger 1 owing to the flow through the second cooling circuit 13. The fluid pump 10 can further intensify said flow.

Since the flow generated owing to convection is small, the use of an additional fluid pump 10 is advantageous. The flow through the second cooling circuit 13 can be actively influenced by means of the fluid pump 10.

To prevent a short-circuit flow between the second fluid inlet 8 and the second fluid outlet 7, a flap 12 is provided in the collecting box 4. Said flap is configured such that, in the closed state, it prevents a flow within the collecting box 4 between the second fluid inlet 8 and the second fluid outlet 7. The flap 12 is thus a means for reducing or preventing a fluid flow between the second fluid inlet and the second fluid outlet 8, 7. In the open state, however, the flap 12 does not influence, or has only a slight influence on, the flow within the collecting box 4.

In addition, in the collecting box 4 in FIG. 1, there is provided a partition 11 which extends through the collecting box 4 along the main direction of extent of the flat tubes 16. The partition 11 divides the collecting box 4 into a left-hand region and a right-hand region. The partition 11 constitutes a means for increasing the pressure loss within the collecting box 4.

Said partition 11 serves for increasing the pressure drop between the left-hand part and the right-hand part of the collecting box 4. The partition is advantageously positioned so as to be arranged between the second fluid inlet 8 and the second fluid outlet 7. This is advantageous but not imperative.

If the partition 11 is not arranged between the second fluid inlet 8 and the second fluid outlet 7, it has no influence on the generation of a short-circuit flow.

If the partition 11 is arranged between the second fluid inlet 8 and the second fluid outlet 7, the generation of an undesired short-circuit flow between the second fluid inlet 8 and the second fluid outlet 7 is additionally inhibited. The partition 11 inhibits a short-circuit flow in particular when the heat exchanger 1 is traversed by flow from the first cooling circuit in the usual way.

In one advantageous embodiment, the partition 11 is positioned so as to be arranged within the collecting box 4 in a projection of the area of the opening of the fluid outlet 6. Here, said partition may be formed so as to extend into the first fluid outlet 6 or even extend through the first fluid outlet 6 as far as into the coolant line. In alternative embodiments, the partition may also be configured so as not to extend all the way through the collecting box.

In alternative embodiments, the second fluid inlet and the second fluid outlet may also be arranged on one side of the first fluid outlet. It is then likewise the case that a flap must be positioned between the first fluid inlet and the first fluid outlet in order to prevent the generation of a short-circuit flow.

Furthermore, it may likewise be provided that the first fluid outlet and the second fluid outlet are provided in different collecting boxes. It is however advantageous for the second fluid outlet 7 to be arranged on the same collecting box 4 as the first fluid outlet 6. It is ensured in this way that the fluid that flows into the second cooling circuit 13 is at as low a temperature as possible. The fluid that flows out of the heat exchanger 1 through the first fluid outlet 6 has generally passed through the entire cooling path in the block 2 of the heat exchanger 1 and is therefore at a relatively low temperature in relation to the fluid flowing into the heat exchanger.

As a result of the branching-off of the fluid at as low a temperature as possible, the cooling action for the component 9 to be cooled is kept as high as possible.

Figure 2:
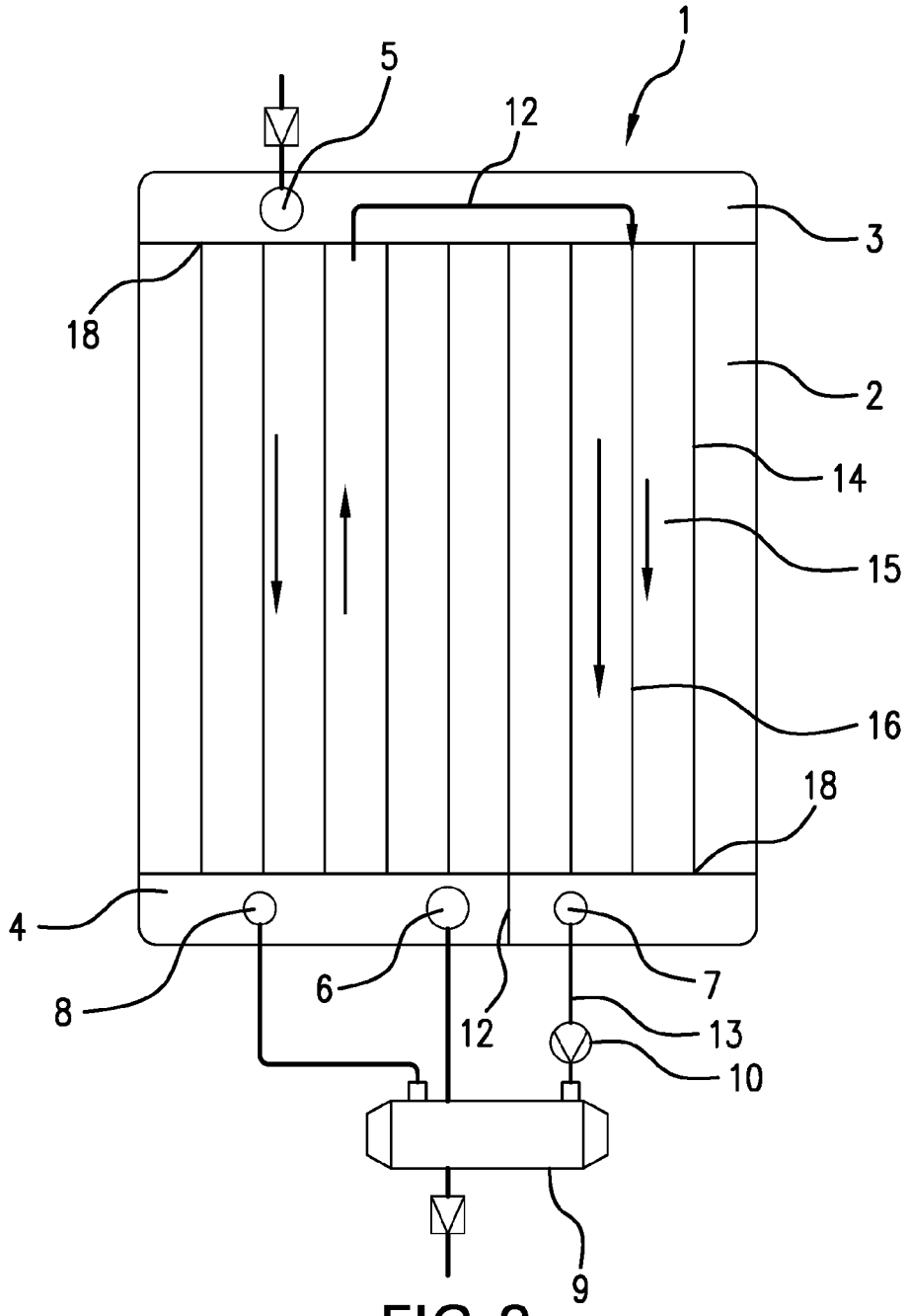
FIG. 2 shows a schematic view of the heat exchanger of FIG. 1, wherein an alternative flow is illustrated.

FIG. 2 shows a state of the heat exchanger 1 in which the flow through the first cooling circuit is prevented by virtue of a thermostat being closed. The flap 12 is closed, whereby no fluid communication between the left-hand part of the second collecting box 4 and the right-hand part of the second collecting box 4 is possible. The fluid flow that passes from the upper first collecting box 3 downward to the second collecting box 4 through the flat tubes 16 is diverted in the second collecting box 4 and flows upward back to the first collecting box 3. This takes place at least in the flat tubes 16 assigned to the left-hand part of the heat exchanger 1. A diversion from the left-hand part of the heat exchanger 1 into the right-hand part of the heat exchanger 1 may in this case take place, along the flow arrow 22, in the first collecting box 3.

The fluid that flows from the first collecting box 3 downward into the second collecting box 4 along the flat tubes 16 in the right-hand part of the heat exchanger 1 can flow into the second cooling circuit 13 via the second fluid outlet 7, and finally, after flowing through the component 9, can flow through the second fluid inlet 8 into the left-hand part of the second collecting box 4.

Thus, when the flap 12 is closed and the thermostat in the first cooling circuit is closed, the fluid can circulate through the heat exchanger 1 and the second cooling circuit 13. Said circulation can then be additionally intensified by the activation of the fluid pump 10. By means of an activation of the fluid pump 10, the flow speed in the right-hand part of the heat exchanger 1 can be increased, and that in the left-hand part of the heat exchanger 1 can be slightly reduced.

In the second cooling circuit 13, as a component 9 to be cooled, there is provided a condenser which is used for the utilization of exhaust-gas heat. By means of an activation of the fluid pump 10, the flow through the heat exchanger 1 can be increased.

Figure 3:
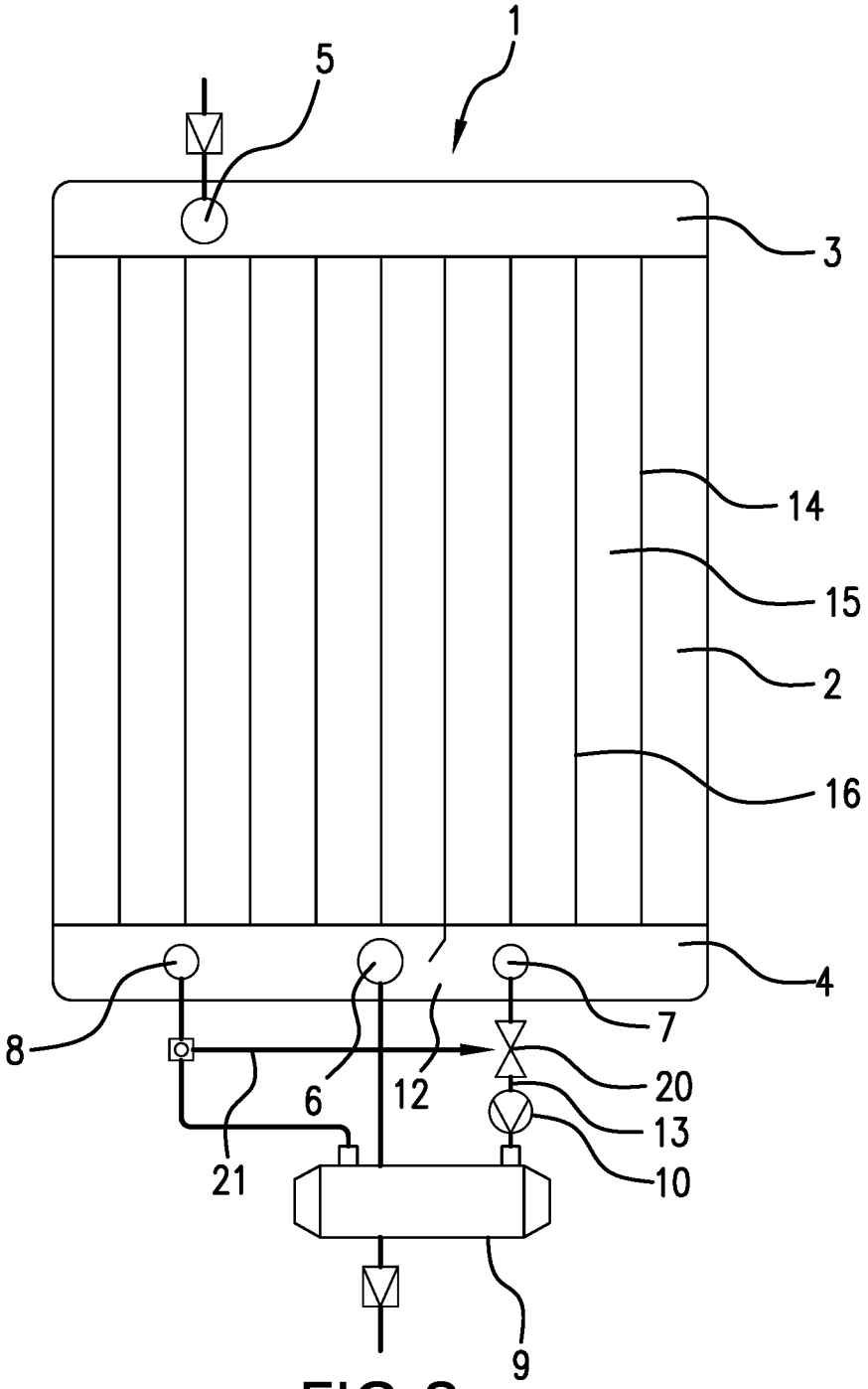
FIG. 3 shows a schematic view of the heat exchanger as per FIGS. 1 and 2, wherein an additional thermostat valve is provided in the second cooling circuit.

FIG. 3 shows a view of the heat exchanger 1. The design of the heat exchanger 1 corresponds to the design of the heat exchanger 1 from FIGS. 1 and 2.

In FIG. 3, in the second cooling circuit 13, there is additionally arranged a thermostat valve 20 which is positioned directly downstream of the second fluid outlet 7. Depending on the position of the thermostat valve 20, the fluid flowing out of the second fluid outlet 7 can flow either through the fluid pump 10 into the component 9 or via a bypass 21 directly to the second fluid inlet 8. In this way, the fluid flow in the second cooling circuit 13 can be influenced by means of active control of the thermostat 20.

Here, the control of the thermostat 20 is in particular dependent on the temperature of the fluid within the heat exchanger 1 and the prevailing cooling demands on the component 9 and/or on the components connected to the first cooling circuit.

The individual features of FIGS. 1 to 3 may be combined with one another in any way. The figures have no limiting nature and serve for illustrating the concept of the invention.

The invention claimed is:

1. A heat exchanger for a motor vehicle comprising:

a block comprising parallel tubes, wherein fins are arranged between said parallel tubes, wherein the parallel tubes form multiple first flow ducts through which a first fluid can flow, wherein the regions between the parallel tubes form multiple second flow ducts through which a second fluid can flow around the parallel tubes, a first collecting box fluidically connected to a first end of the parallel tubes, wherein a first fluid inlet is arranged on the first collecting box, a second collecting box fluidically connected to a second end of the parallel tubes, wherein a first fluid outlet is arranged on the second collecting box, wherein one of either the first collecting box or the second collecting box comprises a second fluid inlet and a second fluid outlet arranged on the same collecting box, a first cooling circuit comprising the first fluid inlet, the first fluid outlet, the first collecting box, the second collecting box, and the multiple first flow ducts, a second cooling circuit comprising the second fluid inlet, the second fluid outlet, at least one of the multiple first flow ducts, and the collecting box on which the second fluid inlet and second fluid outlet are arranged, wherein the first cooling circuit and the second cooling circuit are joined along the same flow path in at least one of the multiple first flow ducts, and wherein the second cooling circuit branches off from the first cooling circuit at the collecting box on which the second fluid inlet and second fluid outlet are arranged.

2. The heat exchanger according to claim 1, wherein the first fluid inlet is arranged on an end region of the first collecting box, and wherein the first fluid outlet is arranged in a central region of the second collecting box.

3. The heat exchanger according to claim 2, wherein the second fluid outlet and the second fluid inlet are arranged on the second collecting box, wherein the first fluid outlet is arranged between the second fluid outlet and the second fluid inlet.

4. The heat exchanger according to claim 2, wherein the parallel tubes are embodied as flat tubes, wherein each tube of the flat tubes has a large flat side, wherein a plane of the flow ducts refers to a plane running parallel to the large flat side surfaces of the flat tubes, wherein the first fluid inlet, the first fluid outlet, the second fluid outlet and the second fluid inlet are arranged in a direction perpendicular to the plane of the flow ducts.

5. The heat exchanger according to claim 1, wherein the heat exchanger further comprises a partition arranged between the second fluid inlet to the second fluid outlet, wherein the partition is arranged in the first or in the second collecting box.

6. The heat exchanger according to claim 1, wherein the heat exchanger further comprises a flap arranged between the second fluid inlet to the second fluid outlet, wherein the flap is arranged in the first or in the second collecting box.

7. The heat exchanger according to claim 5, wherein, a pressure difference between the first fluid outlet and the second fluid outlet is variable as a function of a pressure difference between the second fluid inlet and the second fluid outlet or as a function of the fluid temperature in the second cooling circuit.

8. The heat exchanger according to claim 1, wherein at least one of the fluid inlets is configured as a fluid inlet connector or at least one of the fluid outlets is configured as a fluid outlet connector.

9. A motor vehicle comprising of a heat exchanger according to claim 1, wherein a component to be cooled is integrated into the second cooling circuit, or a component to be cooled and a fluid pump are integrated into the second cooling circuit.

10. The motor vehicle according to claim 9, wherein the second cooling circuit further comprises a thermostat valve for regulating or controlling the fluid flow through the component to be cooled.

11. The heat exchanger according to claim 2, wherein the second fluid outlet and the second fluid inlet are arranged on the second collecting box, wherein the second fluid outlet and the second fluid inlet are arranged on one side of the first fluid outlet.

12. The heat exchanger according to claim 1, wherein the heat exchanger further comprises a valve arranged between the second fluid inlet to the second fluid outlet, wherein the valve is arranged in the first or in the second collecting box.

* * * * *